US008281419B2

(12) United States Patent
Rietdyk et al.

(10) Patent No.: US 8,281,419 B2
(45) Date of Patent: Oct. 9, 2012

(54) ADJUSTABLE NECK, BACK AND SHOULDER PROTECTIVE APPARATUS

(76) Inventors: Guido Rietdyk, Rolling Hills, CA (US); Kevin Heinz, Palos Verdes Estates, CA (US)

( * ) Notice: Subject to any disclaimer, the term of this patent is extended or adjusted under 35 U.S.C. 154(b) by 724 days.

(21) Appl. No.: 12/250,323

(22) Filed: Oct. 13, 2008

(65) Prior Publication Data

US 2010/0088808 A1 Apr. 15, 2010

(51) Int. Cl.
*A41D 13/00* (2006.01)

(52) U.S. Cl. ..... 2/468; 2/459; 2/467; 602/5; 602/18

(58) Field of Classification Search ..... 2/455, 468, 2/44, 462, 456, 102, 410, 461, 463, 467, 2/411, 425, 45, 459; 602/18, 17, 19, 5, 32–40; 128/DIG. 23
See application file for complete search history.

(56) References Cited

U.S. PATENT DOCUMENTS

| | | | | |
|---|---|---|---|---|
| 3,964,474 | A * | 6/1976 | Fox | 602/18 |
| 4,449,251 | A * | 5/1984 | Gauthier | 2/468 |
| 5,129,101 | A * | 7/1992 | Douglas | 2/462 |
| 5,546,601 | A * | 8/1996 | Abeyta | 2/468 |
| 6,058,517 | A | 5/2000 | Hartunian | |
| 6,067,665 | A * | 5/2000 | DePalma et al. | 2/468 |
| 6,748,601 | B2 | 6/2004 | Lashoto et al. | |
| 6,810,535 | B1 | 11/2004 | Moloney | |
| 7,036,156 | B2 | 5/2006 | Lahman | |
| 7,062,795 | B2 | 6/2006 | Skiba | |
| D542,919 | S | 5/2007 | Leatt | |
| 2003/0060744 | A1 | 3/2003 | Caille et al. | |
| 2004/0210992 | A1 * | 10/2004 | Morrow et al. | 2/455 |
| 2005/0113728 | A1 | 5/2005 | Heinz et al. | |
| 2007/0010771 | A1 | 1/2007 | Leatt | |
| 2007/0118979 | A1 * | 5/2007 | Tobergte | 2/455 |
| 2007/0151004 | A1 * | 7/2007 | Brassill | 2/461 |
| 2007/0156072 | A1 | 7/2007 | Leatt | |
| 2008/0040840 | A1 | 2/2008 | Morrow et al. | |
| 2008/0092281 | A1 | 4/2008 | Morrow et al. | |

FOREIGN PATENT DOCUMENTS

| | | |
|---|---|---|
| GB | 779717 | 7/1957 |
| GB | 2126485 | 3/1984 |

* cited by examiner

*Primary Examiner* — Danny Worrell
*Assistant Examiner* — Khaled Annis
(74) *Attorney, Agent, or Firm* — Los Angeles Patent Group; Arman Katiraei

(57) ABSTRACT

An orthopedic protective assembly is disclosed. The orthopedic protective apparatus includes a foam shaped collar to conform to a user's neck area. The foam shaped collar comprises a multi-layer polymer material having a pliable outermost protective layer to absorb initial impact energy and additional layer(s). The additional layer(s) require(s) greater impact energy to deform than those of the pliable outermost protective layer. In one embodiment, shim extension(s) customize(s) impact energy absorption properties of the foam shaped collar by filling a gap between an underside of the foam shaped collar and a shoulder region of a user.

9 Claims, 11 Drawing Sheets

ADJUSTABLE NECK, BACK AND SHOULDER PROTECTIVE APPARATUS

BACKGROUND OF THE INVENTION

1. Field of the Invention

The invention relates generally to the field of injury prevention gear and orthopedic assemblies, and specifically in one exemplary aspect to an adjustable neck brace and vertebrae apparatus to reduce user impact related injuries.

2. Description of Related Technology

Orthopedic assemblies are well known in the art. Such assemblies are utilized to prevent user injuries from sudden or unexpected impacts as well as provide an ergonomic fit. Some related art patents discussed below (and incorporated by reference in their entirety) are representative art of these conventional assemblies. In one related art example, US 2008/0040840 published Feb. 21, 2008, by Morrow et al. entitled "Protective Athletic Equipment" discloses an upper body garment for cushioning blows imparted upon the wearer's body including a chest protector portion, a back protector portion, and a pair of telescopic shoulder portions to form an integral unit. In yet another related art example, US 2008/0092281 entitled "Protective Athletic Equipment" by Morrow et al. published Apr. 24, 2008, discloses an upper body garment for cushioning blows imparted upon the wearer's body includes a chest protector portion, a back protection portion, and a pair of telescopic shoulder protector portions. The protective garment includes a variety of different designs formed in the outer surface of the chest protector, the back protector portion and the pair of shoulder protector portions.

In another related prior art, U.S. Pat. No. 6,748,601 entitled "Articulating Body Protective Device" by LaShoto et al. issued Jun. 15, 2004, discloses an articulating body protective device for protection from impact-based injuries, especially related to sport activities, provided by a composite body protector. The composite body protector has a fabric outer garment and protective elements, in particular soft elements and semi-rigid and rigid elements that are selectively provided in predetermined locations within the outer garment for protecting vital organs and other body parts from injuries to impact during sports or athletic activities. In yet another related art, U.S. Pat. No. 6,810,535 that issued Nov. 2, 2004 entitled "Helmet Restraint System" by Moloney discloses a helmet restraint device for operationally securing a helmet worn by a driver. The helmet restraint device includes a high strength, lightweight rod disposed behind and below the occupant's neck, just beneath the shoulders harness, and a strap that attaches between the occupant's helmet and the rod.

In yet another related art, U.S. Pat. No. 7,036,156 entitled "Head Protection System" that issued May 2, 2006, by Lahman et al. discloses a head protection system includes an open-ended tubular cap band of flexible material for partially encircling the head of a wearer generally at the level of the wearer's forehead. In yet another related art, U.S. Pat. No. 7,062,795 entitled "Lightweight Impact Resistant Helmet System" that issued Jun. 20, 2006, by Skiba et al. discloses a strong, lightweight impact resistant helmet system. Efficient impart absorption by the helmet shell is accomplished by limiting the bend curvature produced at the impact location. The bend curvature reduction increases contact area between the helmet shell and a pliable padded inner helmet made from energy absorbing polymeric foam disposed within the helmet shell in contact with the inner surface. The reduced bend curvature of the helmet spreads impact forces over a large area and the impact load experienced by the wearer is decreased.

In contrast to the above instances, a protective apparatus may further be desired to achieve still wider variety of protection and/or impact reducing options and provide improved user comfort and wearing pleasure as well as provide various types of and configurations that are adjustable to fit a user without requiring complicated attachment/de-attachment hardware. For instance, eliminate or reduce the need for buckles, bolts, or screws to secure a protective device to your body. For in yet another instance, a protective device may be needed that provides breathability and airflow at least in designated areas or expose a larger effective surface area so that impact is further reduced for a user. In another instance, a manufacturer or user may find it beneficial that a protective device have one or more removable and washable components. Furthermore, a user may further desire the protective device to be easily assembled or disassembled "on the fly" and easily installed or removed on a user's body so that assembly/removal time is minimized. In addition, a user desires the protective device durable but also conformable to wear and to create minimal restriction to a user's movement.

Thus, what is needed are improved protective apparatus and methodology that permits easy initial configuring and reconfiguring, i.e., provide adaptability, and upgrade capability so that the same unit be utilized (or added-on to) if new functionality (e.g., chest protection) is desired. Furthermore, such improved apparatus and methods would also ideally allow a person other than a professional or licensed personal to adjust or retrofit the orthopedic device, and would further permit creation of user-customized orthopedic configurations and customized fit and appearance of the orthopedic device as well as new patterns requiring minimal efforts, e.g., minimal adjustment or removal and replacement or adaptation of an existing components.

SUMMARY OF THE INVENTION

In a first aspect of the invention, an orthopedic protective apparatus (e.g., assembly) is disclosed. The orthopedic protective assembly includes a foam collar that conforms to a user's neck region. In one embodiment, the foam collar includes a polymer material shaped to conform to a user's neck area. The polymer material includes an initial absorption barrier and a user contact area. In one embodiment, the initial absorption barrier includes a layer of pliable polymer or plastic foam.

Continuing with this embodiment, layers of polymer material (e.g., dual density plastics) are added to the initial absorption barrier to increase neck brace rigidity (from that of initial absorption barrier) proximal to an impact area, e.g., contact area of user skeletal structure. In one variant, the foam collar includes a fastening apparatus, for instance, that connects detachably with one or more shims to adjust dimensionality of the foam collar (e.g., a gap) to that of a user's neck area. In another variant, the foam collar and one or more shims are secured together using a sleeve (e.g., a Lycra® sleeve) that, in example, stretches to accommodate a changing number of shims and foam collar thicknesses). In yet another variant, the sleeve attaches to the orthopedic protective assembly, for instance, using Velcro® hook and loop fasteners. Accordingly, a modular collar system is disclosed including foam collar and shims.

In one embodiment, the one or more shims adjust the foam collar to match that of an individual's neck length. In one variant, a user utilizes a helmet and shoulder pads and one or more shims to adjust a location (e.g., height, effective thickness) of the foam collar to match a gap between a wearer's helmet and neck and shoulder region (or rigid contoured chassis) to provide even further protection, in event of an sudden or unexpected impact, to a user's muscular and skeletal components.

In a second aspect of the present invention, a rigid contoured chassis (e.g., concave shaped) is disposed on a user neck and upper shoulder area is disclosed. The rigid contoured chassis diffuses initial impact energy using, for example, cup-shaped, edges of concave-shaped outer surfaces. In one embodiment, the rigid contoured chassis operatively cooperates with the foam collar and shims, for example, with Velcro® fastener. In one embodiment, the rigid contoured chassis is disposed with an inner liner (e.g., a bio-foam insert). In one variant, the inner liner is a pliable material (e.g., soft and deformable) to contact a user's skeletal and muscular groups including a neck and shoulder region (e.g., neck and shoulder junction). In variant, the inner linear is disposed within the rigid contoured chassis. In one embodiment, the bio-foam insert includes a unidirectional oriented, axially sculptured surface that aligns with skeletal and/or muscular groups (e.g., shoulder, upper neck region, lower neck region).

In yet another embodiment, an outer surface polymer material of the bio-foam material includes a cup-shaped structure to spread and diffuse (e.g., channel) impact energy over a larger user's skeletal and muscular area than that of an initial impact area (e.g., fall location on a ground or rocky surface). In yet another embodiment, a neck-to-chest protector harness is disclosed that includes a quick-connect strapping apparatus integrally connected with the rigid a user's clavicle (collarbone) and detachably connected to a user's chest area, for example, through fastener(s) located at a side surface of the inner liner and fastener(s) located on the quick-connect release strapping apparatus.

In a third aspect of the invention, a vertebrae protective apparatus (provides lower spinal column support) is disclosed. In one embodiment, the vertebrae protective apparatus has features included in the rigid contoured chassis and also part of the inner liner. In one embodiment, the rigid contoured chassis includes, for instance, a spinal cord portion conforming to a protruding skeletal structure element. In one embodiment, the rigid shaped chassis includes a glass filled plastic. In one embodiment, the inner liner includes a heat-molded cross-link bio-foam lined with Lycra® fabric. In one embodiment, the protruding skeletal structure includes, for example, an outer portion of a spinous process of lamina of a user's vertebrae. In one embodiment, the inner liner includes a c-shaped foam area to conform to a protruding skeletal structure (e.g., spinous process of an outer tip of lamina) of a user's vertebrae. In one alternative embodiment, a series of stress bars are integrally formed into a back of the rigid contoured chassis to reinforce an upper portion and a lower portion thereof.

In yet another embodiment, a chest protection fastening apparatus is disclosed. In yet another embodiment, a chest protection apparatus fastener includes quick-snap disconnect apparatus as well as various hook and loop fasteners to integrate (with web looping) a conventional chest protector therewith.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

Figure 1:
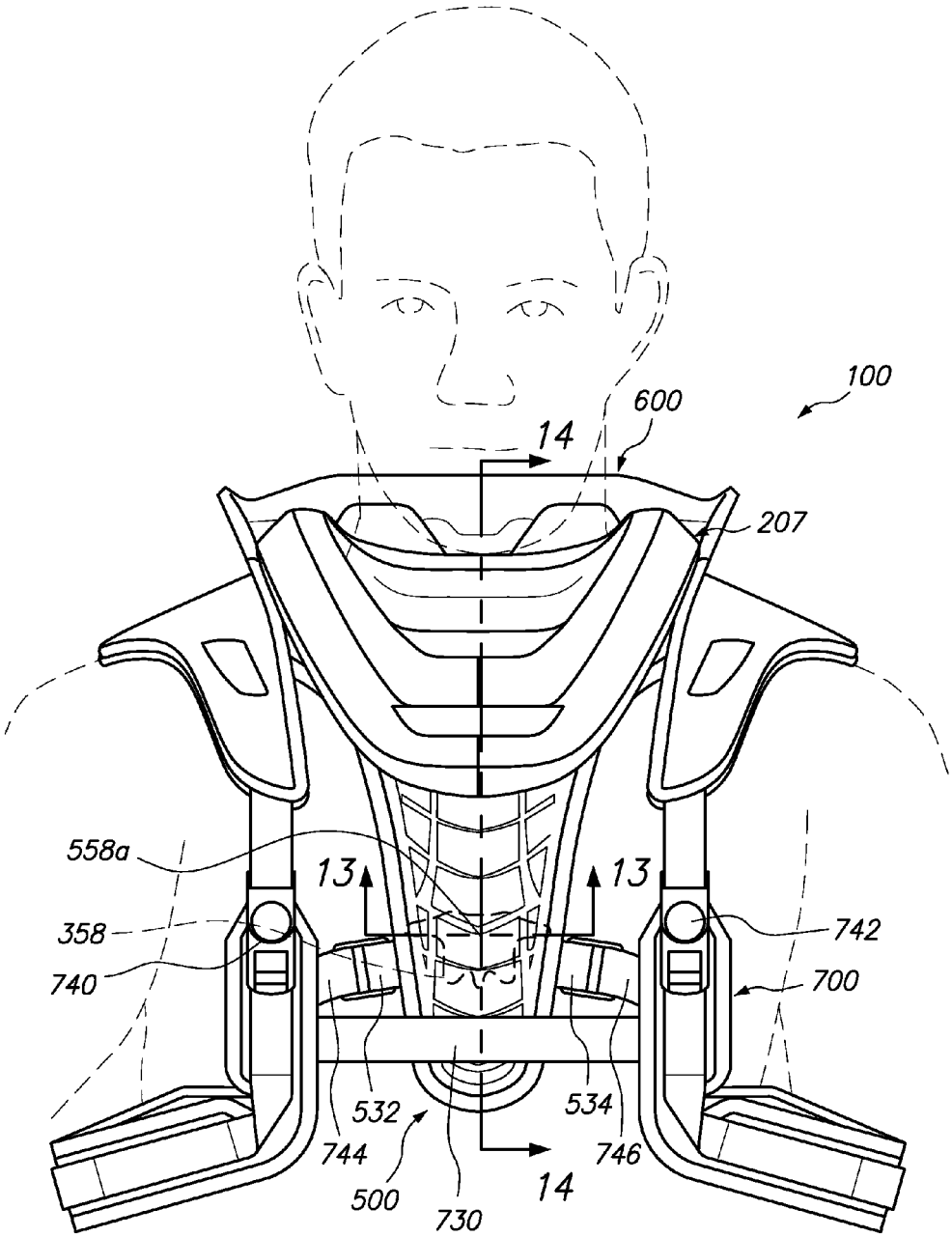
FIG. 1 is a front view of an assembled orthopedic protective apparatus illustrating foam collar, pliable, axially directional, padded sculptured inner liner, rigid contoured chassis (including vertebrae protective chassis), and neck-to-shoulder attachable harness in accordance with an embodiment of the present invention.

Reference is now made to the drawings wherein like numerals refer to like parts throughout.

Overview

In one salient aspect, the present invention discloses apparatus and methods for, inter alia, producing orthopedic protective apparatus as well as provide custom capabilities, in one variant, to produce various configurations to conform to, for instance, a user's neck length or customized to a particular helmet or neck protective chassis configuration. In particular, the present invention discloses an apparatus and process to provide an orthopedic protective apparatus having a multi-part shim, for instance, to meet a user's individual skeletal dimensionality, e.g., orthopedic device easily adjusted to match an individual's physical dimensions to achieve a closer fit and function and provide improved protective properties thereof.

Furthermore, the present invention discloses an orthopedic protective apparatus applicable to protect a user while participating in outdoor, high impact sports, e.g., motorcross racing, motor bicycle racing, all terrain vehicle riding, having adjustment and attachment capability, for instance, quick release fasteners to removably attach a multitude of protective devices attached thereto. For instance in one or more embodiments, the multitude of protective devices includes helmet, shoulder pads, rigid, sculptured vertebrae chassis, inner linear, and a chest protector.

In light of the present invention, users may customize and choose a desired level of protection responsive to a chosen sport or terrain or environment for a particular day or event; thus, this present inventive apparatus provides adaptability as compared with conventional one unit protection (pads) or multi-unit protection units (shoulder pads, helmet . . . ), where all units are required to be utilized. Furthermore, the orthopedic protective apparatus includes stress bars and minimal weight composite materials to improve user comfort (decreasing overall weight as compared to solid, non-aerated conventional vertebrae chassis) and prevent unnecessary restriction of user movement (provide built-in flexibility). In addition, the orthopedic protective apparatus integrates energy channeling capability using an impact reducing mesh base topology (e.g., stress bars).

Accordingly, the apparatus advantageously allows multiple configuration styles and supports many different system configurations through its ability to provide a significant flexibility of rapid adjustment to create new "customized" fit, e.g., using, for instance, loop and hook fasteners, multi-shim attachments, stretchable cover or sleeve, and harness removably attachable that is disposed proximal to a clavicle and chest and provide quick-connects and disconnects. In addition, the principles of the present invention are applicable to other applications, e.g., injury rehabilitation, muscular isolation therapy, and strength training sessions.

Exemplary Extension Apparatus

Referring now to FIGS. 1-14, exemplary embodiments of the orthopedic protective apparatus of the invention are described in detail. It will be appreciated that while described primarily in the context of an orthopedic protective apparatus, at least portions of the apparatus and methods described herein may be used in other applications, such as for example and without limitation applications including employees working in a high risk of impact environment, e.g., skyscraper window washers, construction workers at risk of falling while performing work duties on building scaffolding and exposed beams, skateboarding participants in high risk events, water skiing participants, rehabilitating motor cross participants, and the like. Moreover, it will be recognized that the present invention may find utility beyond purely orthopedic protective concerns.

For example, the "orthopedic protective apparatus" described subsequently may be conceivably modified to be useful in reducing impact forces and breakages when shipping by regular US mail or by air mail, for instance, commonly shaped or irregularly shaped, breakable items (e.g., glass lamp, crystal chandelier shipped by land or air) whereby shape of orthopedic protective device may be modified, e.g., cup-shaped structure 555*a*, to conform to the physical and dimensionally of fragile features and aspects of these above mentioned breakable items, and the like. A myriad other functions will be recognized by those of ordinary skill in the art given the present disclosure.

Figure 2:
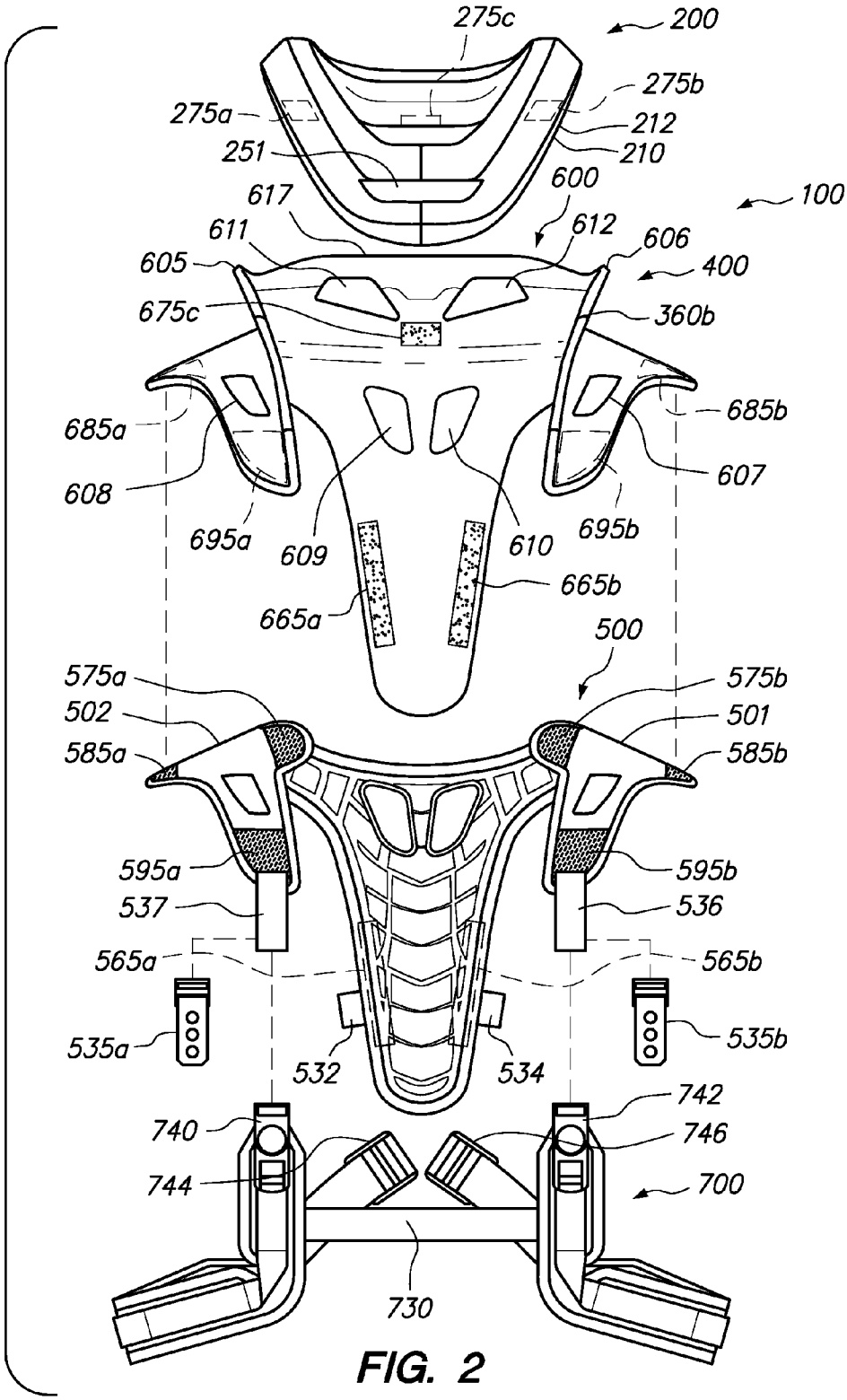
FIG. 2 is a front view of a disassembled orthopedic protective apparatus illustrating foam collar, shims, pliable, axially directional, padded sculptured inner, rigid contoured chassis (including vertebrae protective chassis) and neck-to-shoulder attachable harness in accordance with an embodiment of the present invention.
Figure 3:
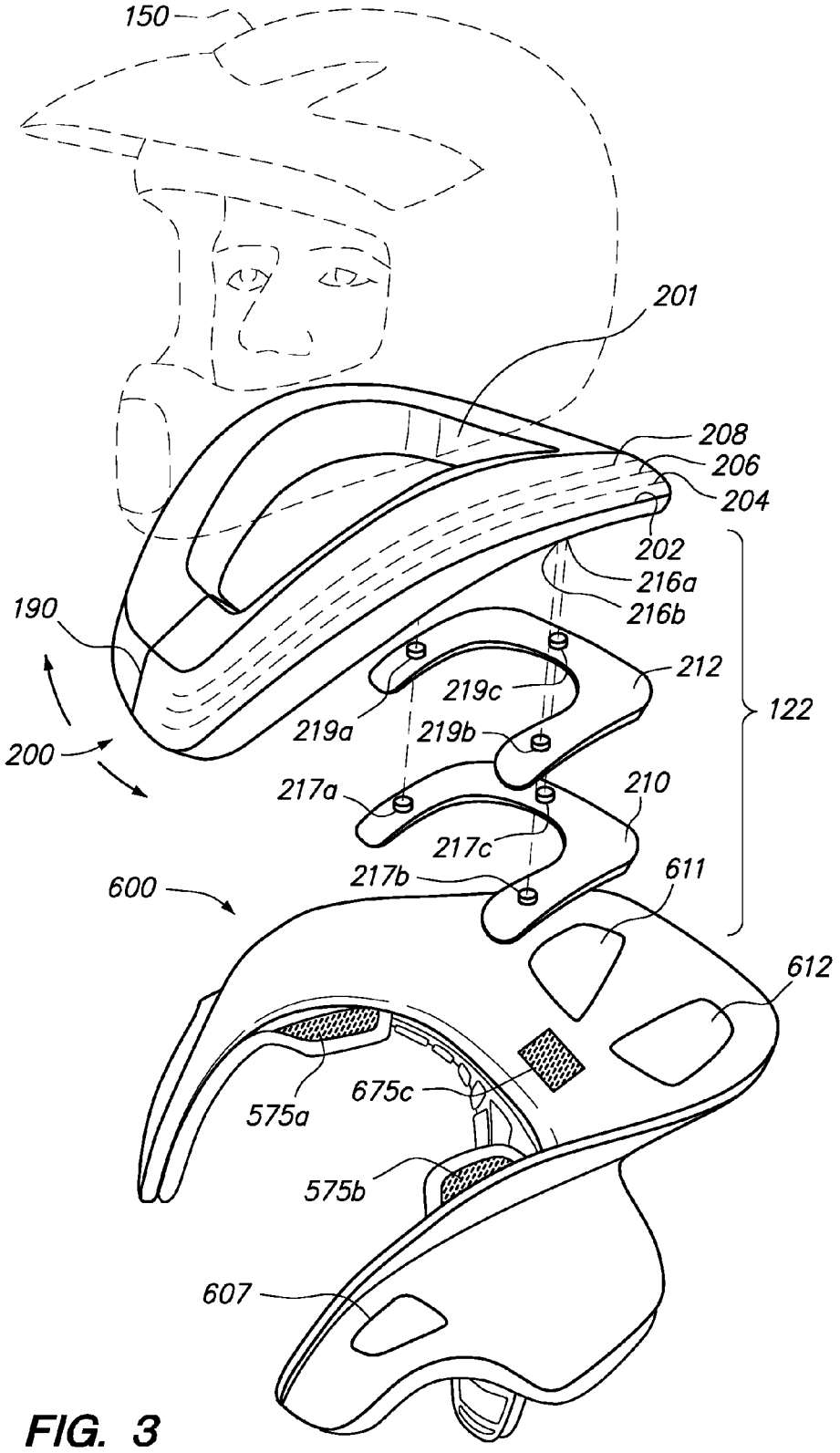
FIG. 3 is a perspective side view of an assembled orthopedic protective apparatus illustrating foam collar and shims and upper section of rigid contoured chassis in accordance with an embodiment of the present invention.

Referring to FIGS. 1 and 2, an orthopedic protective apparatus 100 is disclosed illustrating an assembled and disassembled configuration, respectively. As best illustrated in FIG. 3, orthopedic protective apparatus 100 includes foam collar 200 having user neck conformal portion 201, for example, constructed of a polymer material. Referring to embodiment disclosed in FIG. 10, cover 207 (including collar 200 inside) may be opened and closed, e.g., flexed open and closed, to wrap around about a user's neck by unfastening, for instance, fasteners 250, 251 (e.g. Velcro®) located proximal to a front center location (such as location 190 on FIG. 3). In one embodiment, the polymer material includes first absorption barrier 202, e.g., circumferential surrounding outer edges, being a pliable, impact absorbing material (e.g., deformable, soft foam edges). In one embodiment, the pliable impact absorbing material includes, for instance, durometer material, polymer, PVC plastic, composite plastic material, a combination thereof or the like. In one embodiment, one or more integrated durometer materials may be utilized for first absorption barrier 202.

Continuing with the same embodiment, layers of polymer material (e.g., durometer materials 204, 206, 208) are integrally made or disposed subsequent to first absorption barrier 202 to increase collar rigidity traveling from first absorption barrier 202 to an area proximal to user neck conformal portion 201, e.g., neck bones of user's skeletal structure. In one embodiment, foam collar 200 includes multiple detachably connected shim(s) to more properly position foam collar 200 position to that of a user's unique physical features (e.g., neck dimensionality and position of a helmet, neck apparatus, shoulder apparatus or the like).

In one embodiment, foam collar 200 and shims 210, 212 are secured together with sleeve (cover) 207 (illustrated in FIG. 8) using fastener 213, e.g., zipper. In one variant, sleeve 207 may be formed of a stretch material (e.g., Lycra®) and attached to rigid contoured chassis 600 with loop and hook fasteners (e.g., Velcro® or the like). In one variant, openings 216*a-c* of foam collar 200 are provided that aligns and inserts into projections 219*a-c* of shim 212. In one variant, shim 212 may include openings on an underside surface and projections 217*a-c* of shim 210 fitting into shim 212 to further adjust position of collar 200. In one variant, shims 210, 212 position foam collar 200 (e.g., adjust a vertical height) to match that of person's neck length.

In another embodiment, shims 210, 212 (foam inserts) adjust position (e.g., height) of foam collar 200 to fill (e.g., match) gap 122 (e.g., behind user's neck) between wearer's helmet 150 (see FIG. 4) and rigid contoured chassis 600. Advantageous as compared to conventional neck brace or shoulder protection systems that merely absorb or deflect impact energy, the present invention protective orthopedic protective apparatus 100 including adjustable shims provides customization for channeling energy through a user's major muscular and skeletal groups.

Figure 4:
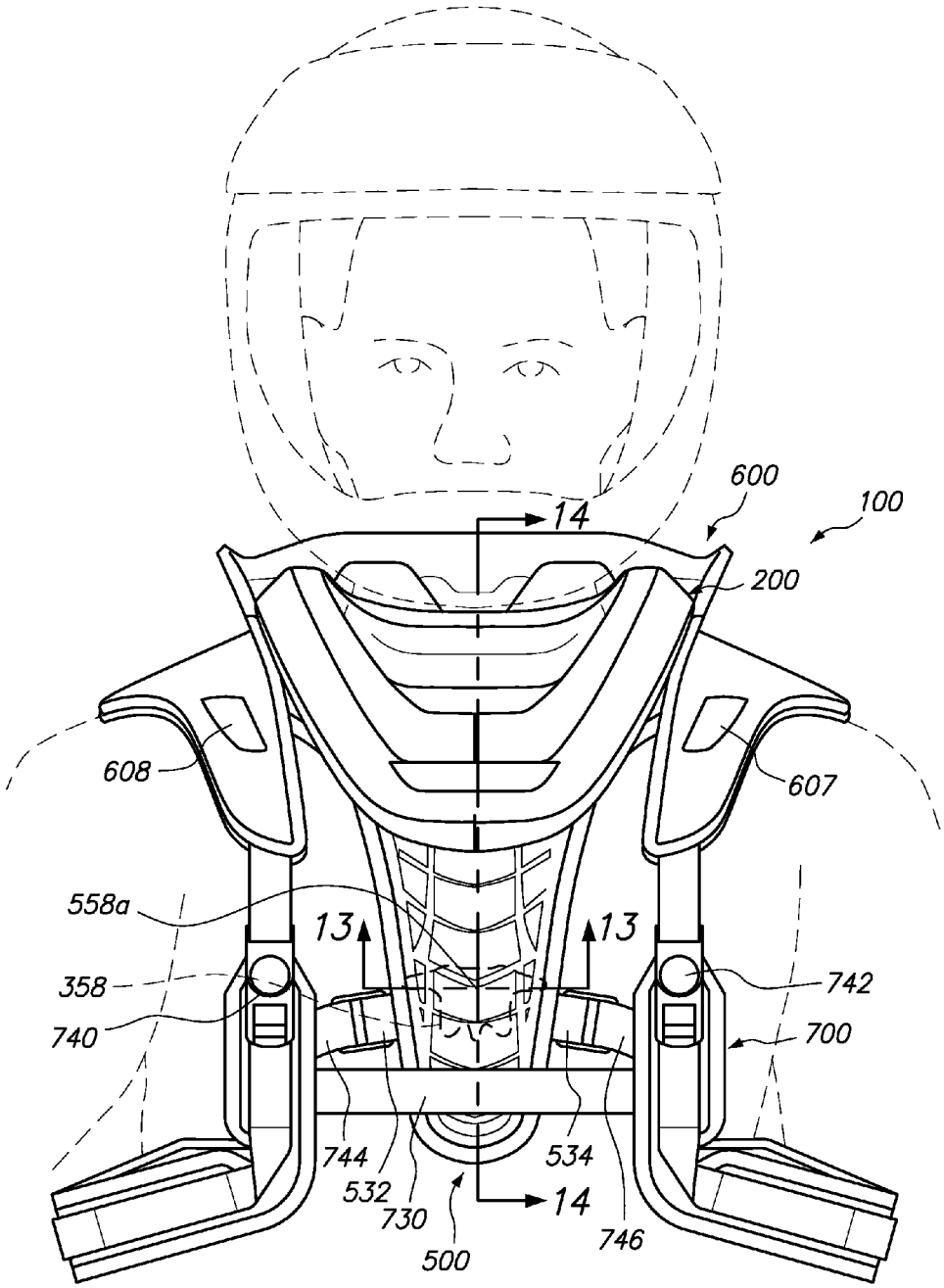
FIG. 4 is a front view of an assembled orthopedic protective apparatus illustrating a user's helmet and shoulder pads that are integrated with functionality of the foam collar, pliable, axially directional, padded sculptured inner liner, rigid contoured chassis, and neck-to-shoulder attachable harness in accordance with an embodiment of the present invention.
Figure 5:
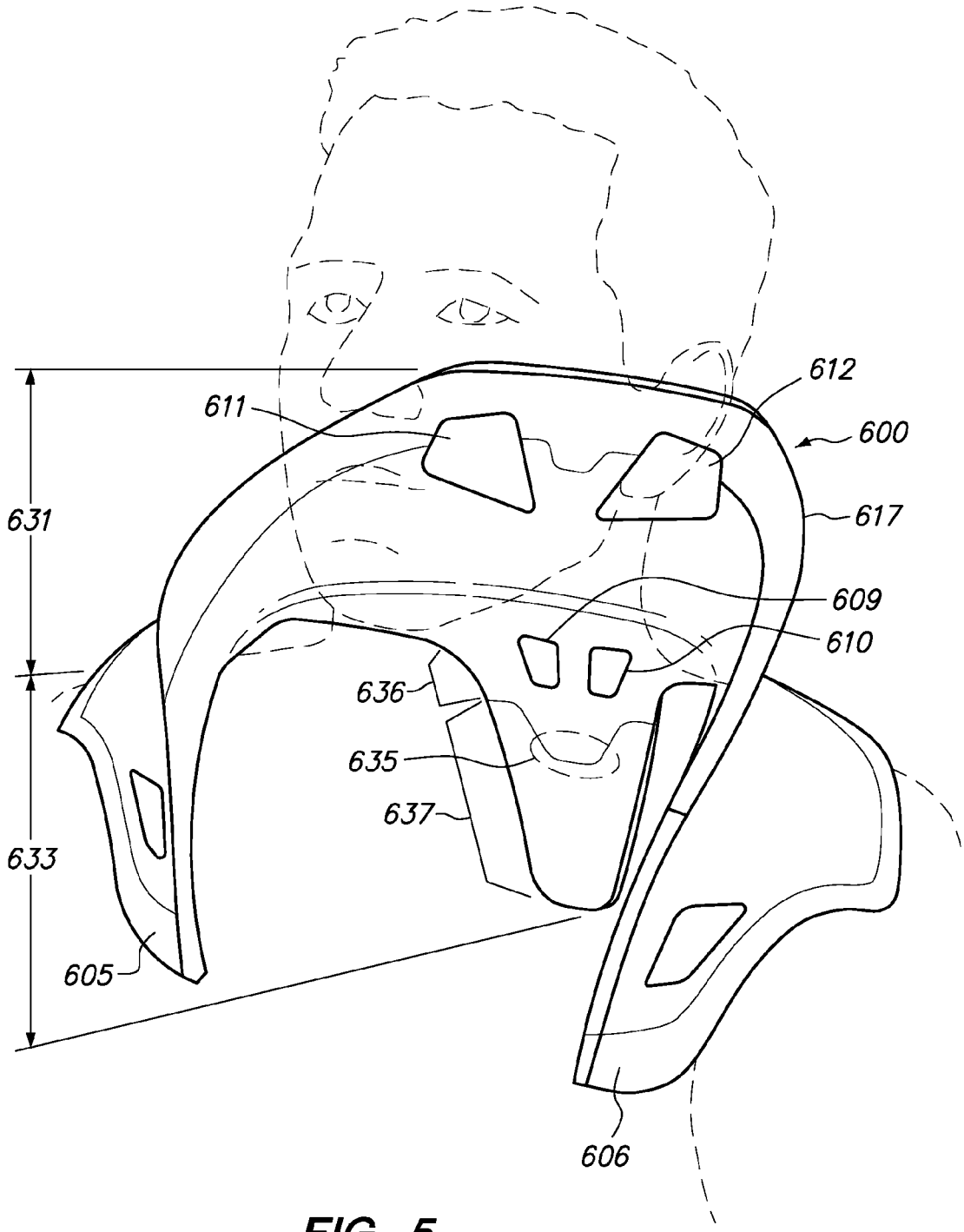
FIG. 5 is a front perspective side view of a rigid contoured chassis on a user in accordance with an embodiment of the present invention.
Figure 6:
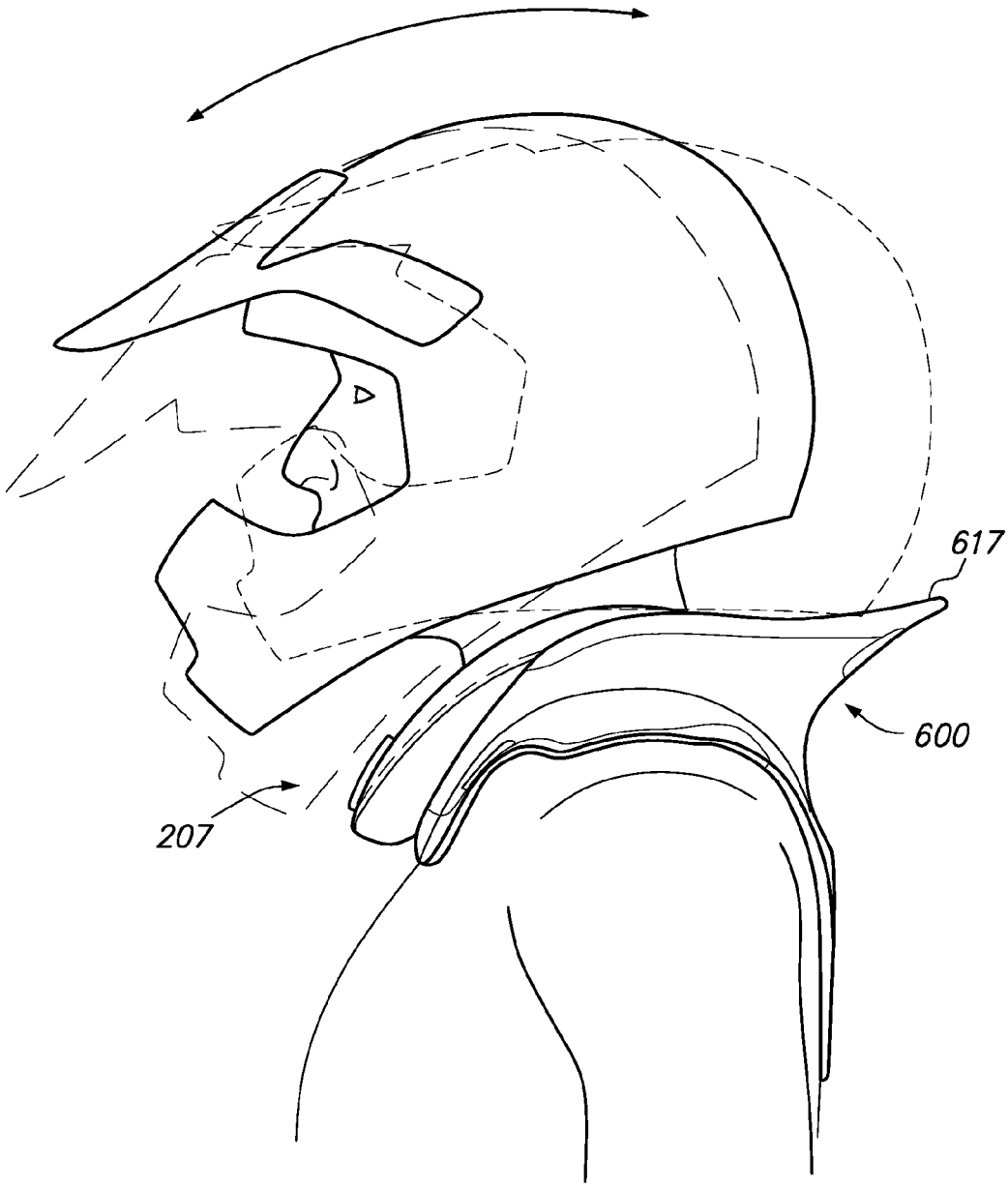
FIG. 6 is a side view of a collar and a rigid contoured chassis illustrating use of protective areas when a user's head is extended back and forth from an impact in accordance with an embodiment of the present invention.

Referring to FIGS. 4, 5, and 6, rigid shaped (ergonomically contoured) chassis 600 is disclosed. The rigid contoured chassis 600 is disposed over inner liner 500 (shown in FIG. 2). Advantageously, the rigid contoured chassis 600 deflects and channels (e.g., in a substantially side-to-side or a rolling fashion) of an initial impact energy (for example of rigid contoured chassis being impacted) along its outer raised surfaces 605, 606, 617, (cupped shaped, raised outer edges). Thus, rigid contoured chassis 600 and collar 200 (see FIGS. 2 and 6) effectively diffuses the initial impact energy (as user's head is extended) to a larger surface area (e.g., skeletal area) than that of the initial impact energy region. In one example, initial impact energy, e.g., upon contact of rigid contoured chassis 600 with a hard surface, e.g., ground, occurs along outer edges 605, 606 (convex shaped surfaces) (shown in FIG. 2) is transferred to surface 202 of collar 200. In yet another example, initial impact area on a helmet 150 or rigid contoured apparatus 600 (see FIG. 5) is transferred through shims 210, 212 along a larger portion of a user's skeletal structure than that of an initial impact area.

Figure 9:
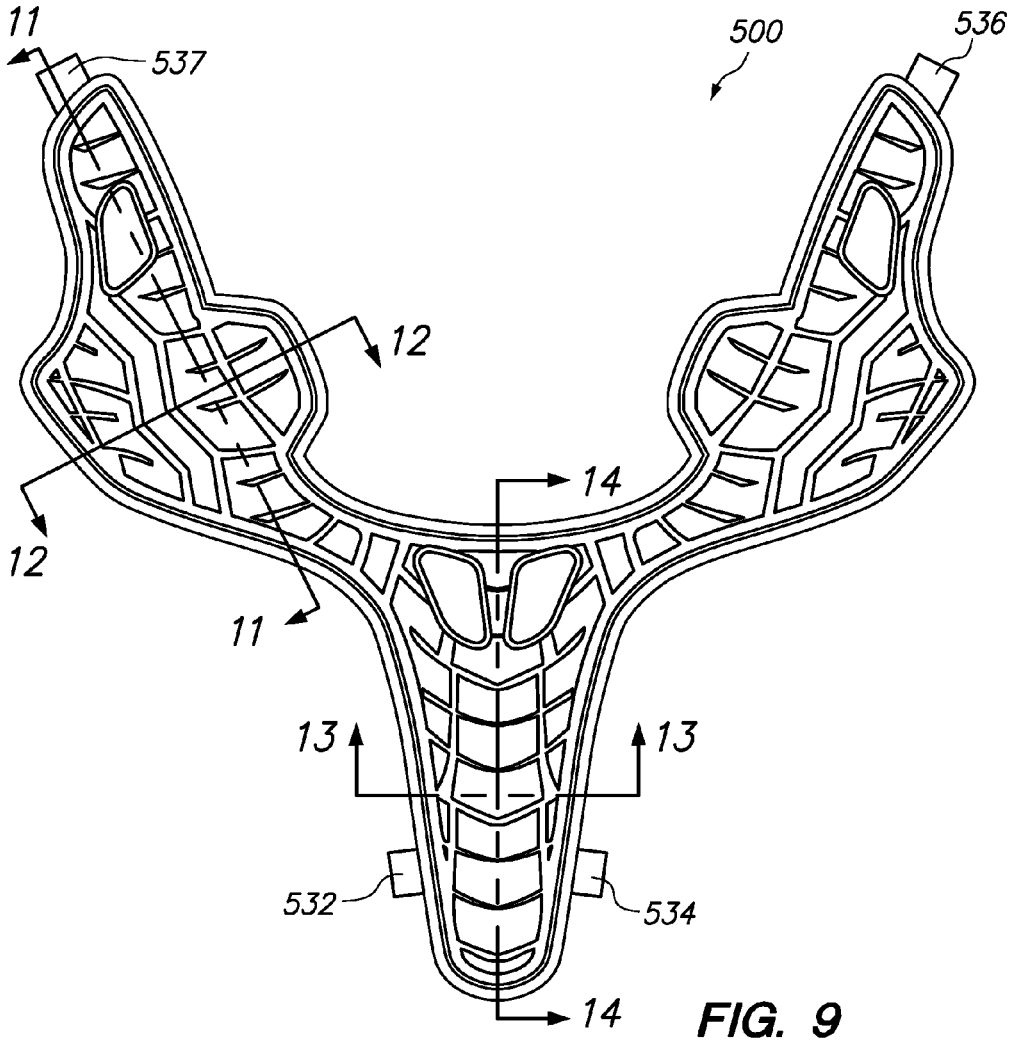
FIG. 9 is an expanded top view of a pliable inner liner illustrated in FIGS. 1 and 2 to illustrate a unidirectional oriented, axially sculptured surface conforming to a user's skeletal features in accordance with an embodiment of the present invention.
Figure 10:
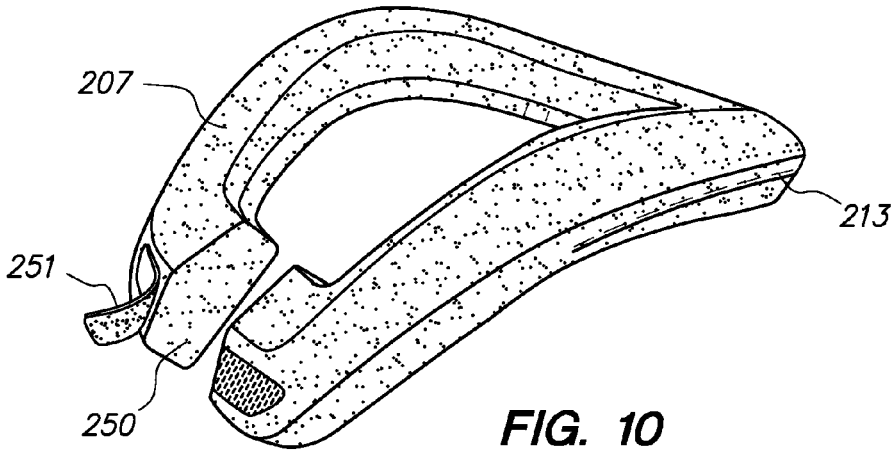
FIG. 10 is a perspective view of a sleeve with removable fastener to open and close flexible collar to aid user attachment accordance with an embodiment of the present invention.

As best illustrated in FIGS. 2 and 9, inner liner 500 is shown. Inner liner 500 is a pliable, compressible material. In one embodiment, inner liner 500 includes a sculpted bio-foam material that contacts user's shoulder region 404. In one variant, inner liner 500 (shown in FIG. 7) includes a unidirectional oriented, axially sculptured surface manufactured from, for instance, a bio-foam material or composite thereof. In one example, to achieve sculptured surface, inner liner is manufactured from a heat-molded cross-link bio-foam material. In one alternative embodiment, inner liner 500 may include a stretch fabric, e.g., a Lycra® fabric, to provide stretch capacity to minimally restrict a user's range of motion. The details of inner linear 500 will be disclosed with reference to subsequent embodiments.

Figure 7:
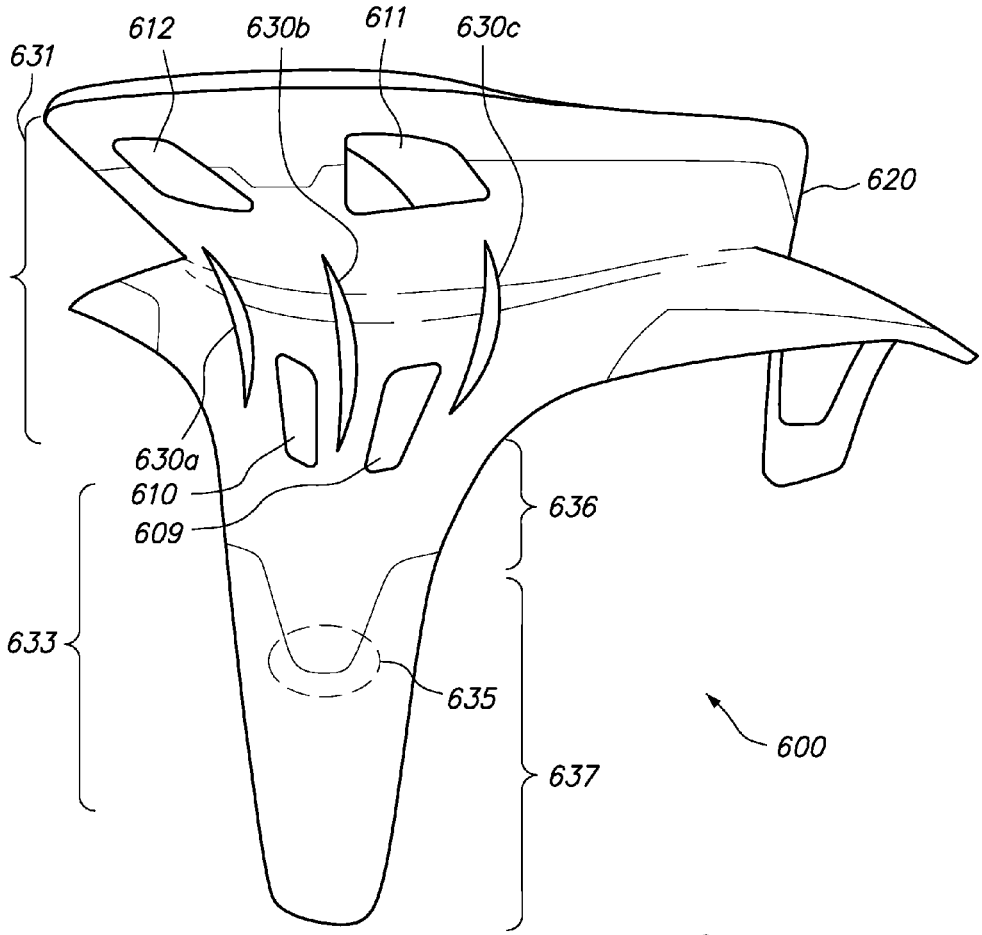
FIG. 7 is a perspective rear view of a rigid contoured chassis of FIG. 5 in accordance with an embodiment of the present invention.
Figure 8:
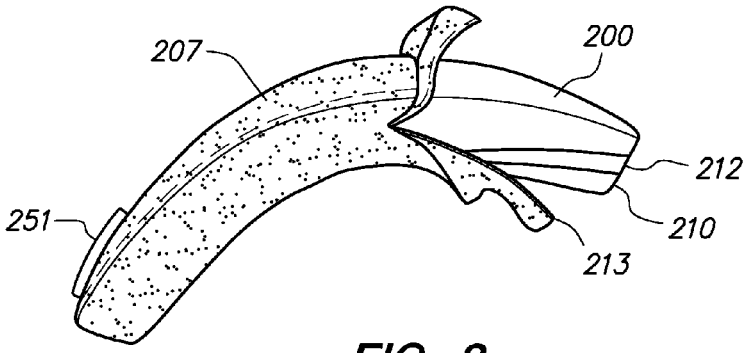
FIG. 8 is a side view of a sleeve that holds and secures the collar and the shims for attachment to the rigid contoured chassis in accordance with an embodiment of the present invention.

Referring to FIGS. 5 and 7, rigid contoured chassis 600 includes outer u-shaped (convex shaped) protective chassis components neck/upper shoulder support 605, neck/upper shoulder support 606, and neck support 617. In one embodiment, outer u-shaped protective chassis 605, 606, 617 components includes rigid polymer material (e.g., glass filled-plastic composite material) having cup-shaped structure (e.g., semi-circular structure) to spread (channel) impact energy over user's larger muscular and/or skeletal group area (s) than that of an initial impact area. Operatively coupled with vertebrae protective chassis, inner liner 500 (shown in FIGS. 2 and 7) provides support and channels impact energy across one or more chosen muscular or skeletal region(s). In contrast to conventional protective apparatus having a single pad structure or construction, the present invention utilizes pad structures and impact relief portions (e.g., stair-step height adjustment and air gaps) to achieve an orthopedically proper fit to spread impact energy across a selected user muscular group or user skeletal group to minimize or reduce an effect of impact injuries.

In one variant, rigid contoured chassis 600 includes a vertebrae protective chassis (apparatus) to protect raised spinal cord portion 635 to conform to protruding skeletal structure 558*a* (e.g., bony protrusion also shown in FIG. 1) of a user's spinal column. The vertebrae protective chassis includes both a rigid portion, for example, included as part of rigid contoured chassis 600 and a soft portion, for example, includes as part of the inner liner 500. In one variant, inner liner 500 includes substantially c-shaped foam area 555*a* (shown in FIG. 13) to conform to protruding skeletal structure 558*a* (e.g., spinous process outer tip of the lamina) of user's spinal column. In one alternative embodiment, a series of stress bars 630*a*, 630*b*, 630*c* are integrally formed (to increase strength of and provide air circulation) in rigid protective chassis 620 to reinforce upper portion 631 and lower portion 633. Advantageously as compared with conventional one piece vertebrae apparatus, the present invention having a vertebrae protective chassis including stress bars 630*a*, 630*b*, 630*c* to create a maximum rigidity while still providing light weight (less plastic material) and provide air ventilation (which would be beneficial to dissipate user's perspiration. In contrast to conventional one plastic type vertebrae apparatus, the present invention vertebrae protective apparatus incorporates a more rigid polymer material 636 on upper portion 631 than that of the polymer material 637 on lower portion 633. Furthermore, the present invention incorporates a soft inner liner 500 and rigid contoured chassis 600 (and in one alternative, air ventilation/aerodynamically designed openings 607, 608, 611, and 612 shown in FIG. 2) which features contrast those of conventional one piece unit.

As best illustrated in FIG. 9, a distinctive bio-foam pattern (e.g., sculptured surface pattern), for example, corresponds to impact portions of on a user's skeletal structure and spinal column. Referring to embodiment in FIG. 2, inner liner 500, for instance, is applied over center portion (e.g., about 565*a*, 565*b* location) and underneath contoured shoulder areas (e.g., about 695*a*, 695*b* location) of rigid contoured chassis 600 so a user's body (such as shown in FIGS. 1 and 4) contacts inner liner 500. In one embodiment, a series of detachably connected fasteners attach inner liner 500 to rigid contoured chassis 600 (see FIG. 2). More specifically, the following fasteners and connections (shown in FIG. 2) are made in this exemplary embodiment, e.g., fastener 595*b* to fastener 695*b*, fastener 595*a* to fastener 695*a*, fastener 585*a* to 685*a*, fastener 595*b* to fastener 695*b*, fastener 595*a* to fastener 695*a*. In addition, collar 200 and cover 207 (not shown) is attached by fasteners 275*a*, 275*b*, 275*c* to fasteners 575*a*, 575*b* shown in FIGS. 2 and 3. Additional novel features of inner liner 500 are disclosed below.

Referring to each of the embodiments disclosed in FIG. 9: embodiment 1 is cross section 11-11 runs in the same plane as user's shoulder region extending from behind neck area, over the shoulder, and in front of the neck area; embodiment 2 is cross section 12-12 runs across the shoulder region; embodiment 3 is cross section 13-13 runs along a vertebrae region of a user; and embodiment 4 is cross section 14-14 runs orthogonal to cross section 13-13. Below are more specific details of each of these cross section regions.

Figure 11:
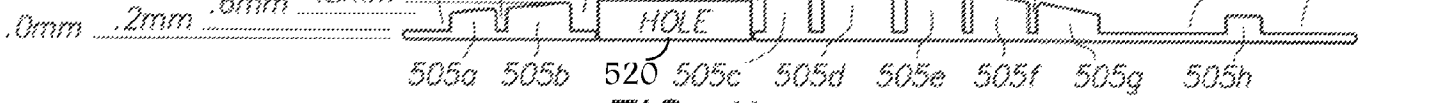
FIG. 11 is a side view of the pliable inner liner of FIG. 9 illustrating cross-section 11-11 structural aspects thereof including air gaps and various height and dimensional pads structures in accordance with an embodiment of the present invention.

Referring to FIG. 11, cross section 11-11, for instance, includes a quasi-stair step foam pattern 505*a-h*. The pattern includes air vents 510*a-j* to provide a cooling pattern for a user and impact relief areas (and hole 520 for attachment, for instance, to inside of rigid contoured chassis 600). The pattern, in one embodiment, increases in vertical height near center of the pattern, e.g., portion over, for instance, large shoulder region to effectively spread impacts provided to a smaller shoulder region.

Figure 12:
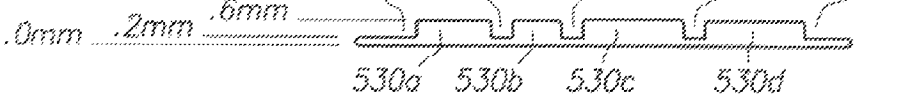
FIG. 12 is a side view of the pliable inner liner of FIG. 9 illustrating cross-section 12-12 structural aspects thereof including air gaps and various height and dimensional pads structures in accordance with an embodiment of the present invention.

Referring to FIG. 12, cross section 12-12, for instance, includes a repeating soft, polymer pad pattern 540*a-d* with cutouts 530*a-d* providing force relief area (to effectively reduce per surface area a received impact force) and air gaps (to increase air flow and reduce impact force). In contrast to conventional vertebrae pads or protective devices, cross section 13-13 (shown in FIG. 13) includes a vertebrae cup-shaped region 555*a* to conform to boney protrusion 558*a* (e.g., lower back element on vertebrae region of a user shown globally in relation to rest of apparatus in FIG. 1) to prevent spinal cord injuries by dissipating and diffusing received impact energy.

Figure 13:
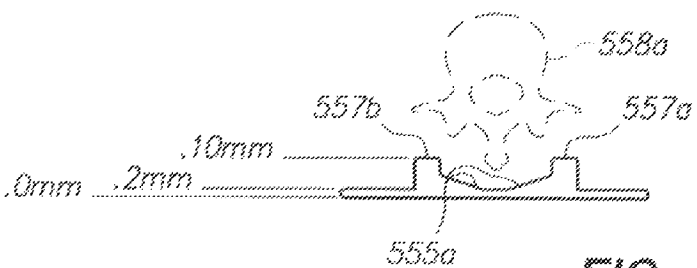
FIG. 13 is a side view of the pliable inner liner of FIG. 9 illustrating cross-section 13-13 structural aspects thereof including air gaps and various height and dimensional pads structures in accordance with an embodiment of the present invention.
Figure 14:
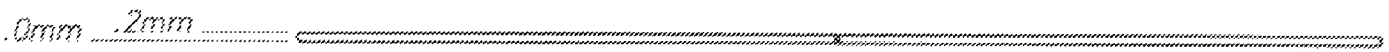
FIG. 14 is a side view of the pliable inner liner of FIG. 9 illustrating cross section 14-14 structural aspects thereof including air gaps and various height and dimensional pads structures in accordance with an embodiment of the present invention.

Referring to FIG. 13, boney protrusion 358 protrudes from a rear part of a user's vertebrae (e.g., spinous process of the lamina, e.g., outer portion of a boney region or tip, as shown globally in relation to rest of apparatus in FIG. 1). In contrast to conventional vertebrae protective devices flat back protectors, in one embodiment provides a soft vertebrae cup-shaped region 555*a* (and pad support structures 557*a*, 557*b*) and hard vertebrae support region 635 (see FIG. 7) provides user protection to maintain spinal curvature of protruding bones as well as prevent or reduce vertebrae bone stress cracks as a result of an injury or impact.

Furthermore, in contrast to previous convention protective apparatus, air vents incorporated as part of the pad structure improves user comfort without sacrificing protective properties of the orthopedic protective device. Finally, in contrast to conventional systems having merely a hard exterior chassis protective device, neck protective chassis utilizes a combination of a hard shell exterior and soft shell inner surface to gradually dissipate the impact energy across a specified muscular or skeletal group. Accordingly, protective structures of the present invention reduce severity or magnitude or eliminate completely a user injury resulting from an impact. In yet another embodiment, neck-to-shoulder protector harness includes quick-connect strapping apparatus contact points 535*a*, 535*b* (shown in FIG. 2) positioned about a clavicle and chest of user are attached to, for instance, hook and loop fasteners 740, 742 (shown in FIG. 2) to further secure rigid contoured chassis 600 and inner liner 500 to a user.

Figure 15:
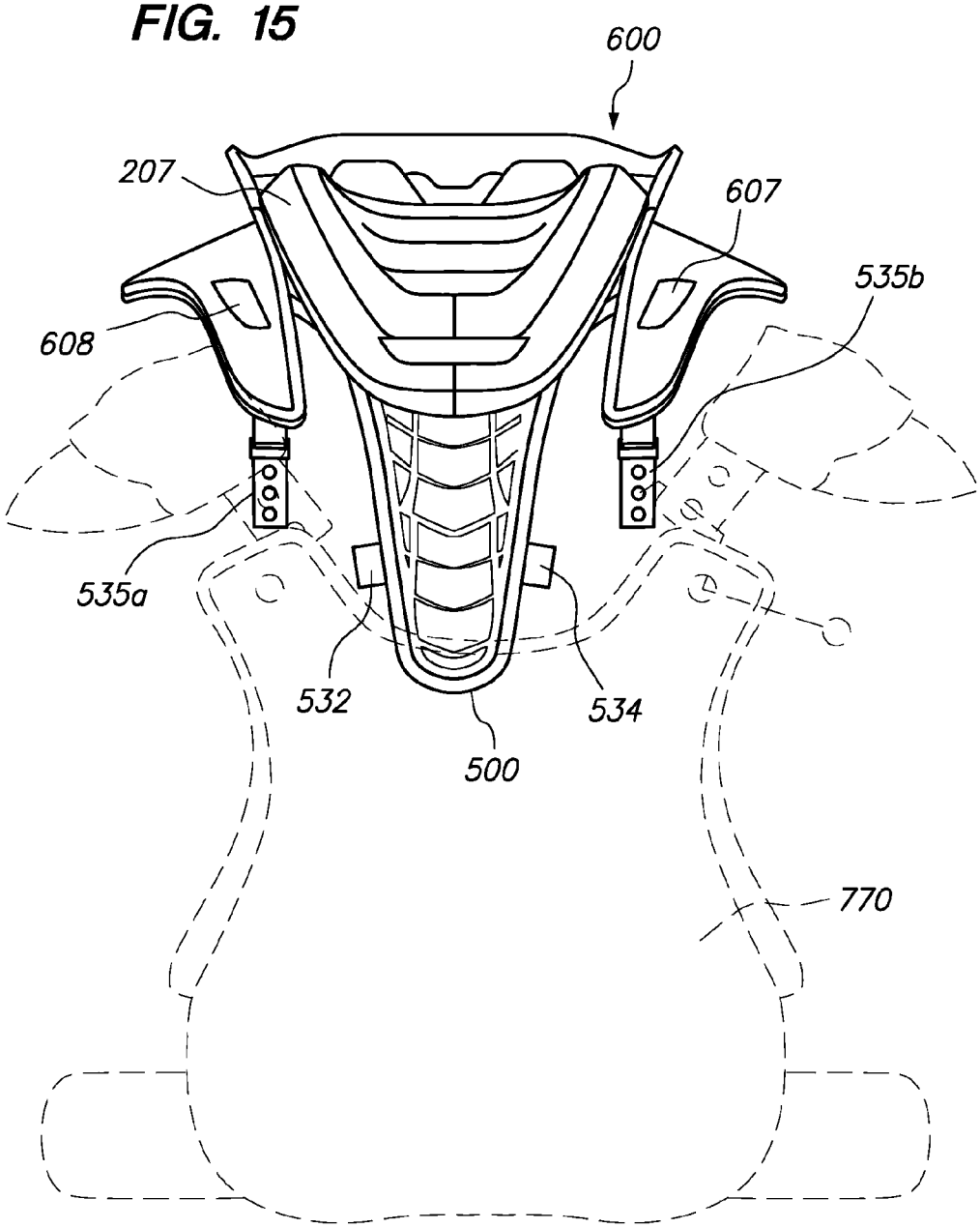
FIG. 15 is a chest protector being attached to the orthopedic protective apparatus in accordance with an embodiment of the present invention.

Referring to FIG. 15, chest protection fastening apparatus 535*a*, 535*b* are disclosed (see also FIG. 2), are attachable fasteners to secure a check protector 770 to the orthopedic protective apparatus 100. In one embodiment, web looping 730 (shown in FIG. 2) provides further secures components of device 100 including a shoulder-to-chest connection so that a conventional chest protection device 770 (shown in dotted lines in FIG. 15 4-4). Furthermore, liner attachments (shown in FIG. 2) are secured, in one example, by rigid contoured chassis 600 through fasteners 740, 742, 744, 746 (shown in FIGS. 1 and 2).

Advantageously, in this embodiment, some of the invention features include an inner liner that is ventilated with sculpted contours for breathability and airflow and spreading impact force from a small surface area to a larger surface area; reinforced padded straps keep the orthopedic protective apparatus secure; buckle less sternum strap (hook and loop) provides micro-size adjustment; soft rubberized edges increase safety margin; hook and loop connection for on-the-fly attachment and detachment of shims for the collar (or the collar itself); removable inner liner that may be washed in a standard washing machine; lightweight design including multi-layered, bio-foam materials and polymers and durometer materials and combinations thereof, and soft hidden tether for attachment of an aftermarket chest protector. Thus, the inventive concepts and mechanism allows a user to achieve protection of skeletal and muscular groups in one or more customized configurations, e.g., hook and loop attachment scheme for retrofitting shims (e.g., in a sleeve or pocket of the neck brace apparatus discussed above.

Exemplary Methods

Figure 16:
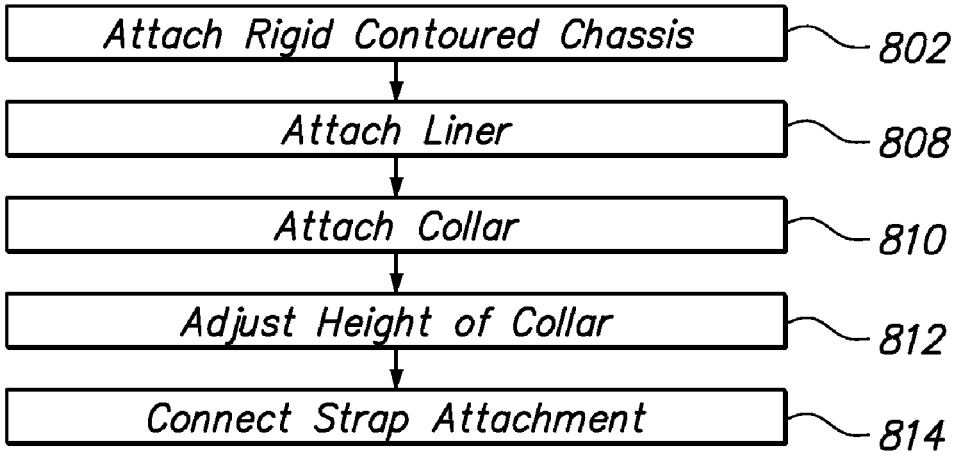
FIG. 16 is a logical flow diagram illustrating one exemplary embodiment of a process for assembling an orthopedic protective apparatus in accordance with the present invention.

Referring now to FIG. 16, an exemplary embodiment of a method 800 for utilizing and assembling the aforementioned orthopedic protective apparatus is described. While described primarily in the context of the exemplary embodiments of apparatus 100 shown in FIGS. 1-15, it will be appreciated that the methodology presented herein may be readily adapted to many different configurations of apparatus 100 as recognized by those of ordinary skill in the art.

In step 802, rigid contoured chassis (outer portion of vertebrae protective chassis) 600 is attached to a user or place on a solid surface. In step 808, rigid contoured chassis 600 is fitted with inner liner 500 (attaches to inner portion of vertebrae protective chassis using, for instance, using fasteners 532, 534, 537, and 538 shown in FIG. 9). In step 810, collar 200 with cover 207 (shown in FIG. 8) is fitted over rigid contoured chassis 600. In step 812, a positional relationship of collar 200 is adjusted with user's neck region using one or more shims 210, 212 detachably attached to collar 200. In step 814, strap attachment 700 is utilized to secure the orthopedic protective assembly 100.

It will be appreciated that while certain aspects of the invention have been described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A spinal column protective apparatus to reduce extent of an impact related injury comprising:

a collar comprising a multi-layer protective foam front region, back region, left lateral region, and right lateral region that produce an irregular shape adapted to substantially encompass and protect a user's neck area from an initial impact energy, wherein the left lateral region extends with a concavity from a leftmost end of the front region and a leftmost end of the back region to a peak that is above a height of the front region and a height of the back region, and wherein the right lateral region extends with a concavity from a rightmost end of the front region and a rightmost end of the back region to a peak that is above the height of the front region and the height of the back region, and wherein the multi-layer protective foam for each region of the front, back, left lateral, and right lateral regions comprises a pliable outermost edge to absorb the initial impact energy and at least one additional protective layer;

wherein the additional protective layer requires a greater impact energy to deform than the pliable outermost edge;

a rigid chassis comprising support means, an upper protective projection, a lower protective projection, and a set of fasteners, the support means having a concave shape adapted to be supported atop a shoulder region of a user, the upper protective projection comprising a rigid outer shell extending upward from the support means to at least a height of the collar so as to surround the back region, left lateral region, and right lateral region of the collar, the lower protective projection comprising a rigid outer shell continuously extending downward from the support means to a length that is adapted to protect a spinal column of the user; and a shim extension apparatus to customize impact energy absorption properties of the collar, the shim extension apparatus fills a gap between an underside of the collar and the upper protective projection of the rigid chassis to custom fit absorption energy properties of the collar, wherein the shim extension comprises a plurality of inserts with one insert of the plurality of inserts directly coupling to at least one of an underside of the collar and the set of fasteners.

2. The spinal column protective apparatus of claim 1, further comprising a sleeve wherein the collar is disposed; and wherein the user chooses to detachably attach at least one foam insert to the collar disposed in the sleeve to align and secure the at least one foam insert to the collar to provide an energy channel that extends from a user's helmet to the shoulder area of user.

3. The spinal column protective apparatus of claim 1, wherein the collar comprises an expandable fastener; and wherein the user chooses to detachably attach one or more of the plurality of inserts within the expandable fastener capable of accepting a multitude of inserts and aligning and securing the at least one insert to the collar.

4. The spinal column protective apparatus of claim 1, wherein the support means and lower protective projection of the chassis each comprise an inner liner, the inner liner comprising a bio-foam material insert having a unidirectional oriented, axially sculptured surface substantially aligned along at least one skeletal group or muscular group to diffuse initial impact energy.

5. The spinal column protective apparatus of claim 4, wherein the inner liner comprises an outer surface polymer material having at least one cup-shaped structure to spread and channel impact energy over a larger effective user skeletal and muscular group or area than that of an initial impact group or area.

6. The spinal column protective apparatus of claim 5, wherein the at least one cup-shaped structure comprises a heat-molded cross-link bio-foam material that substantially conforms to a rear protruding part of a user's spinal column to prevent breakage upon impact.

7. The spinal column protective apparatus of claim 6, wherein the rigid outer shell of the lower protective projection comprises a vertebrae protective apparatus that fits over the inner liner, conforms to a user's spinal cord region, and has a rigid construction.

8. An impact protective apparatus to reduce extent of an impact related injuries for sporting injury when a user wears a helmet comprising:

a collar surrounding a user's neck area, the collar having a foam, multi-layer, polymer structure capable of being opened and closed, a pliable outermost edge to absorb the initial impact energy, and an additional protective layer, the additional protective layer requires a greater impact energy to deform than the pliable outermost protective edge;

a rigid contoured chassis comprising support means, an upper protective projection, and a lower protective projection, the support means having a concave shape adapted to substantially conform to the user's neck and shoulder region, the upper protective projection comprising a rigid outer shell extending upward from the support means to at least a height of the collar as a protective outer skeleton surrounding back, left, and right regions of the collar, and the lower protective projection comprising a rigid outer shell continuously extending downward from the support means to a length that is adapted to protect a spinal column of the user;

a pliable liner disposed within the support means and the lower protective projection, the pliable liner having a unidirectional shaped axial protective orientation along a front side of the liner that corresponds to elements and structural aspects of at least one major muscle or skeletal group of the user;

a shim extension apparatus comprising a plurality of detachable inserts with at least one insert of the plurality of inserts coupling to at least an underside of the collar to fill a gap between the collar and the rigid contoured chassis; and wherein the user chooses to detachably attach the at least one insert to the collar to align and secure the at least one insert to the collar to provide a dissipative energy channel that collects initial impact energy from the helmet, the collar, and the rigid contoured chassis disposed about a neck and shoulder area of the user; and wherein the dissipative energy channel comprises at least one major muscular or skeletal group of the user.

9. The impact protective apparatus of claim 8, wherein the rigid contoured chassis detachably connects; and wherein the pliable liner comprises a substantially c-shaped foam area that aligns with a lower back region of the rigid contoured chassis.

* * * * *

UNITED STATES PATENT AND TRADEMARK OFFICE

CERTIFICATE OF CORRECTION

PATENT NO. : 8,281,419 B2
APPLICATION NO. : 12/250323
DATED : October 9, 2012
INVENTOR(S) : Rietdyk et al.

It is certified that error appears in the above-identified patent and that said Letters Patent is hereby corrected as shown below:

Title Page, Item (76), please replace "Kevin Heinz, Palos Verdes Estates, CA (US)" with --Kevin Hinyub, Palos Verdes Estates, CA (US)--

Signed and Sealed this
Sixth Day of November, 2012

David J. Kappos

David J. Kappos
*Director of the United States Patent and Trademark Office*